US006045031A

United States Patent [19]

Ritter et al.

[11] Patent Number: 6,045,031

[45] Date of Patent: Apr. 4, 2000

[54] METHOD AND DEVICE FOR MANUFACTURING WIRE-LATTICE MATS

[75] Inventors: Klaus Ritter; Gerhard Ritter, both of Graz, Austria

[73] Assignee: EVG Entwicklungs-u.Verwertungs-Gesellschaft m.b.H., Raaba, Australia

[21] Appl. No.: 08/983,389

[22] PCT Filed: Jun. 11, 1997

[86] PCT No.: PCT/AT97/00123

§ 371 Date: Jan. 19, 1998

§ 102(e) Date: Jan. 19, 1998

[87] PCT Pub. No.: WO97/47409

PCT Pub. Date: Dec. 18, 1997

[30] Foreign Application Priority Data

Jun. 10, 1996 [AT] Austria ..... 1043/96

[51] Int. Cl.[7] ..... B21D 39/00; B23K 1/14; B23K 5/22

[52] U.S. Cl. ..... 228/173.5; 228/49.1; 228/212; 140/112

[58] Field of Search ..... 228/173.5, 212, 228/44.3, 49.1, 4.1; 29/446–453; 140/111

[56] References Cited

U.S. PATENT DOCUMENTS

| | | | |
|---|---|---|---|
| 3,651,834 | 3/1972 | Larkin | 140/3 R |
| 3,676,632 | 7/1972 | Ritter et al. | 219/58 |
| 3,814,145 | 6/1974 | Gott et al. | 140/112 |
| 3,889,345 | 6/1975 | Hirschberg . | |
| 4,221,319 | 9/1980 | Paice | 228/25 |
| 4,500,763 | 2/1985 | Schmidt et al. | 219/58 |
| 4,605,046 | 8/1986 | Decoux | 140/112 |
| 4,748,309 | 5/1988 | Ritter et al. | 219/56 |
| 5,113,915 | 5/1992 | Ritter et al. . | |
| 5,211,208 | 5/1993 | Ritter et al. | 140/112 |
| 5,446,254 | 8/1995 | Ritter et al. | 219/56 |

FOREIGN PATENT DOCUMENTS

| | | |
|---|---|---|
| 32 23 321 A1 | 3/1983 | Germany . |
| 837 668 | 6/1981 | U.S.S.R. . |
| 395 229 | 10/1992 | United Kingdom . |
| 42 11 737 A1 | 10/1993 | United Kingdom . |
| WO 90/15677 | 12/1990 | WIPO . |

*Primary Examiner*—Patrick Ryan
*Assistant Examiner*—Kiley Stoner
*Attorney, Agent, or Firm*—Frishauf, Holtz, Goodman Langer & Chick, P.C.

[57] ABSTRACT

A method and apparatus for producing wire grid mats from longitudinal wires and transverse wires (L, Q) crossing one another at right angles and welded at the crossing points, in which the longitudinal wires are advanced incrementally and the transverse wires are moved transversely to the motion of the longitudinal wires into a welding line and are welded to the longitudinal wires, and at least one of the transverse wires, after being delivered to the welding line, is clamped with a predetermined adjustable magnitude, and that before being welded to the longitudinal wires at least one end of this transverse wire is rotated by a predetermined adjustable angle about its longitudinal axis, whereupon the transverse wire is welded to the longitudinal wires.

11 Claims, 2 Drawing Sheets

METHOD AND DEVICE FOR MANUFACTURING WIRE-LATTICE MATS

Figure 1:
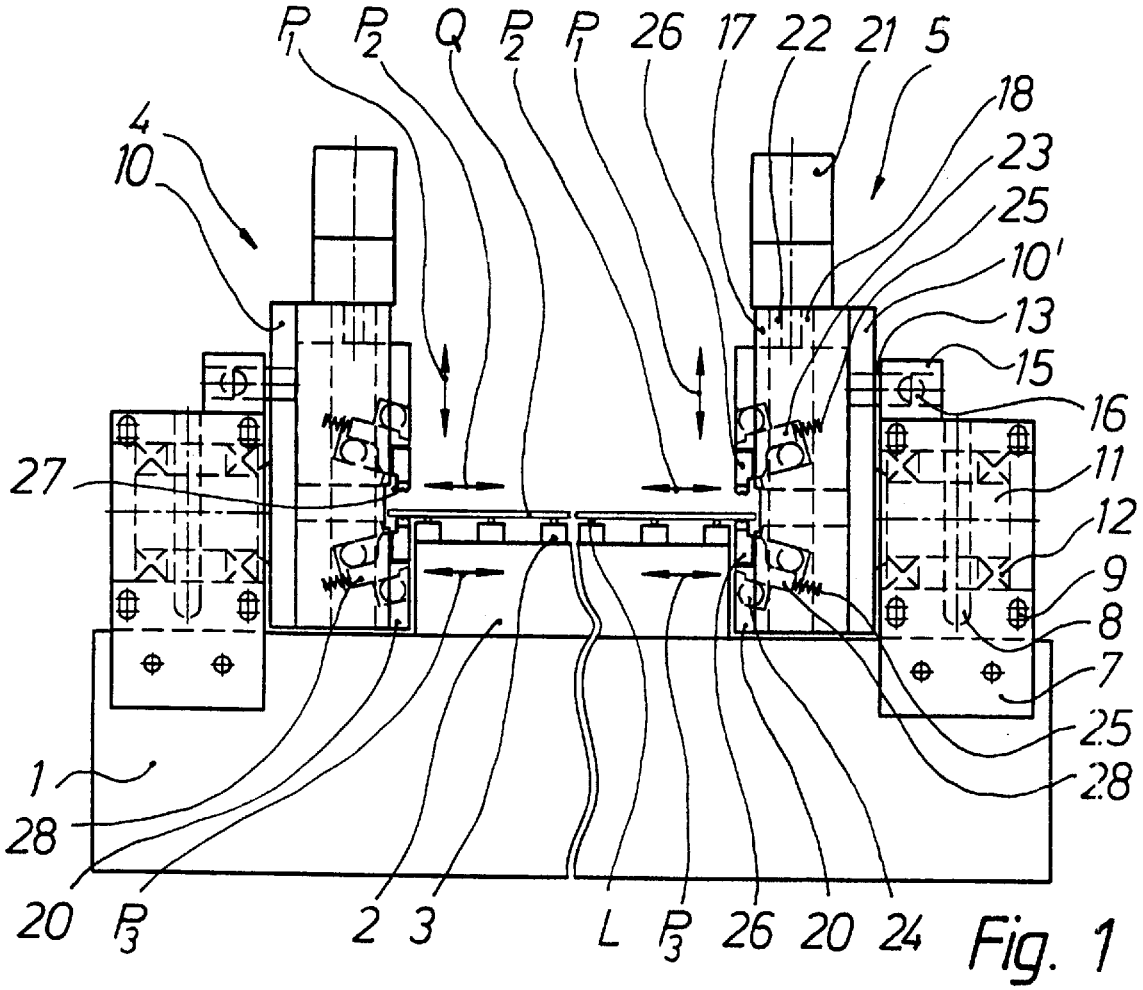

The invention relates to a method for producing wire grid mats from longitudinal wires and transverse wires crossing one another at right angles and welded at the crossing points, in which the longitudinal wires are advanced incrementally and the transverse wires are moved transversely to the motion of the longitudinal wires into a welding line and are welded to the longitudinal wires, and to an apparatus for performing the method.

From Soviet Union Patent SU 837 668, a welding method and a resistance welding machine for producing steel reinforcement grid mats are known in which the transverse wire is clamped while being delivered to the welding line. A disadvantage here is that the clamping force is not adjustable but instead depends on the structurally predetermined increase in spacing of the clamping jaws during the delivery motion and on the spring constants of any relief springs that may be present.

Austrian Patent AT 395 229 to which U.S. Pat. No. 5,113,915, Ritter et al. corresponds, discloses a welding machine for producing wire grid mats that overcomes these disadvantages. However, this welding machine has no devices whatever for treating the longitudinal wires and/or transverse wires, which as a result of their production, pretreatment and/or manipulation in being delivered to the welding line may have a longitudinal twist or residual torsion.

The object of the invention is to disclose a method and an apparatus that, while exploiting the advantage of clamping the transverse wires, make it possible in a structurally simple, operationally safe and reliable way to product flat wire grid mats from longitudinal wires and transverse wires whose residual twist or residual torsion is balanced out. The method according to the invention is distinguished in that at least one of the transverse wires, after being delivered to the welding line, is clamped with a predetermined adjustable magnitude, and that before being welded to the longitudinal wires at least one end of this transverse wire is rotated about its longitudinal axis by a predetermined adjustable angle, whereupon the transverse wire is welded to the longitudinal wires.

In a preferred embodiment of the invention, the two ends of at least one transverse wire may be rotated by equal-sized, oppositely oriented angles. However, it is also possible, within one wire grid mat, for the ends of all the successive transverse wires to be rotated by equal-sized angles, preferably in the same direction. Alternatively, according to the invention, the ends of all the successive transverse wires within one wire grid mat may be rotated by different-sized angles, preferably in the same direction, and the order of the amounts of the rotary angles is selectable, and at least one transverse wire remains unrotated. An apparatus intended for performing the method, having clamping jaws for grasping the ends of the transverse wires and having clamping devices for clamping the transverse wire in the electrode-equipped welding line of a grid welding machine, has the characteristics that on both sides of the longitudinal wire advancement path of the grid welding machine, one rotating and clamping device each is disposed; that in each rotating and clamping device, for clamping one transverse wire end, one upper clamping body each and one lower clamping body each are disposed, vertically displaceably and drivably, in a guide body, and each clamping body has a substantially horizontally displaceable clamping slide; that for rotating one transverse wire end about its longitudinal axis, the guide body is supported with a bearing trunnion rotatably in a stationary bearing body; and that each rotating and clamping device is triggerable separately. Preferably, for clamping a transverse wire end, a work cylinder acting with its piston rod on the upper clamping body and secured to the guide body is provided.

In a refinement of the invention, the guide body has a laterally cantilevered pivot pin extending parallel to the bearing trunnion, and the piston rod of one work cylinder each engages opposite sides of the pivot pin.

By clamping the transverse wires according to the invention and rotating their ends before they are welded to the longitudinal wires, any longitudinal twist and/or residual torsion in the transverse wires, which arises from the production, pretreatment and/or manipulation of the transverse wires as they are delivered to the welding line, is compensated for. After the clamped transverse wires, rotated on their ends, are welded to the longitudinal wires, the transverse wires act upon the longitudinal wires via the welding nodes in such a way that even a longitudinal twist or residual torsion in the longitudinal wires originating in the production, pretreatment and/or manipulation upon delivery to the welding line is compensated for and balanced out.

Figure 2:
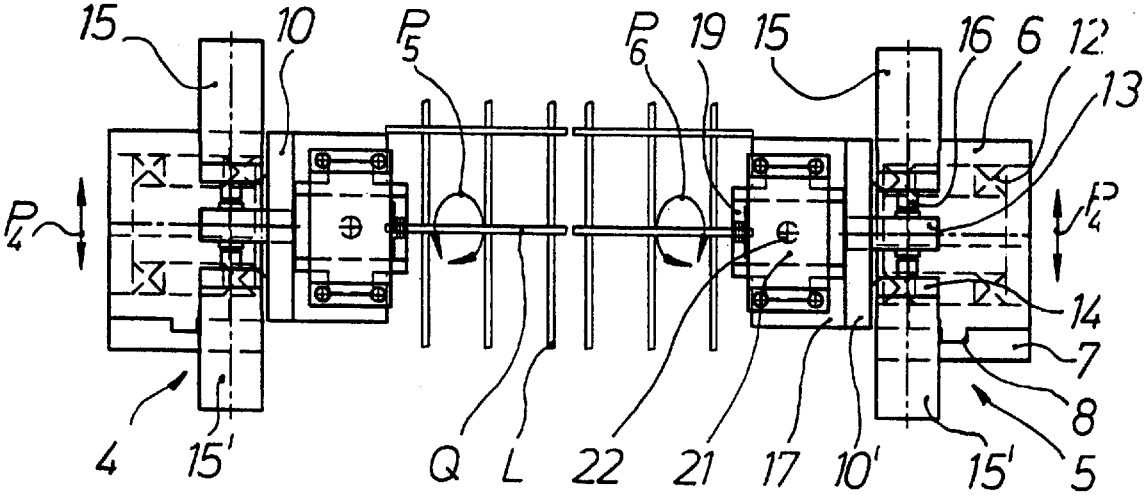

Further characteristics and advantages of the invention will be described in further detail below in terms of an exemplary embodiment in conjunction with the drawings. Shown are:

FIG. 1, a side view of an apparatus according to the invention;

FIG. 2, a plan view of the apparatus of FIG. 1; and

Figure 3:
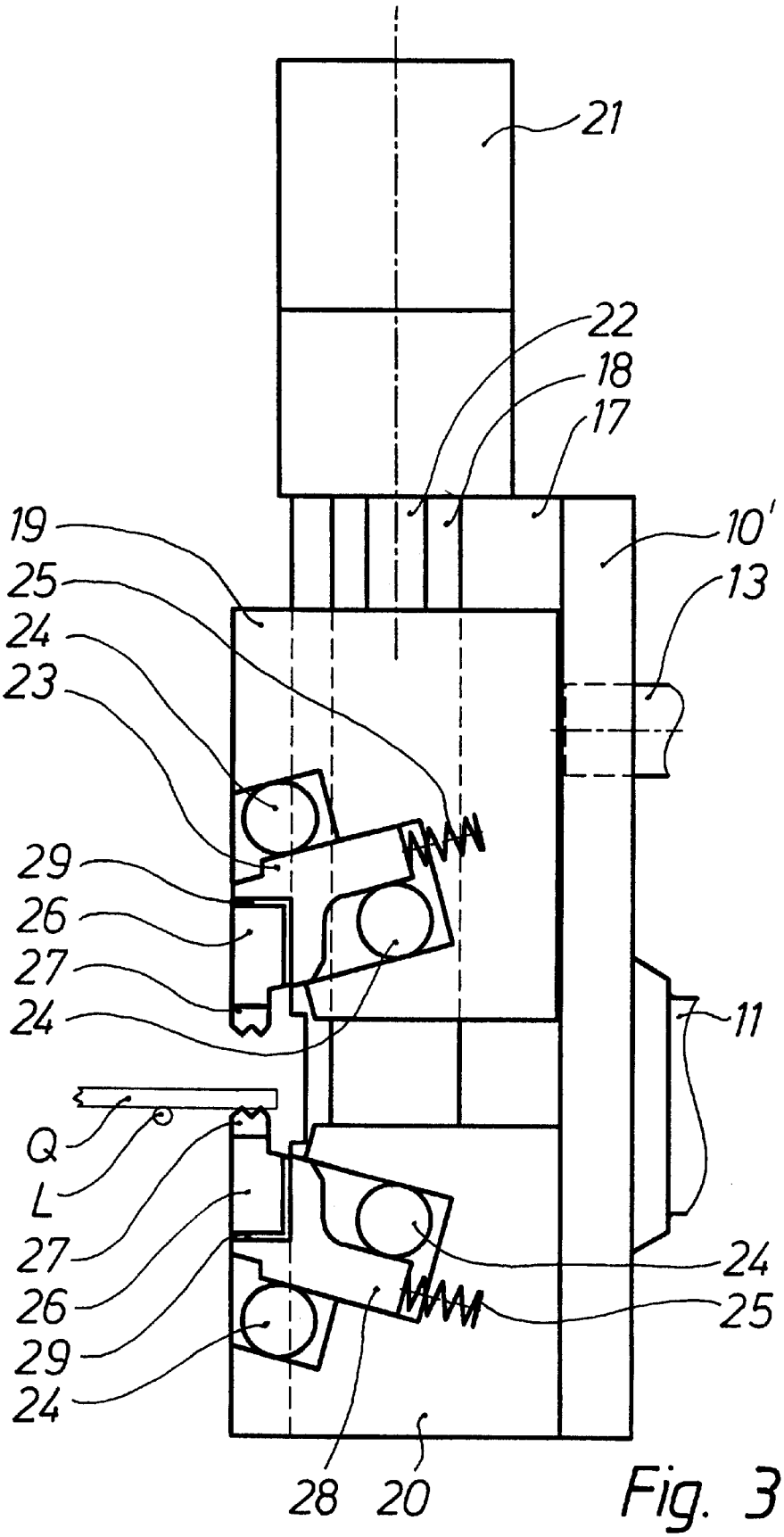

FIG. 3, a fragmentary view of the upper and lower clamping bodies.

The apparatus shown in FIGS. 1–3 is used to produce wire grid mats, which comprise a host of parallel longitudinal wires L and transverse wires Q crossing them at right angles. At the crossing points, the transverse wires Q are welded to the longitudinal wires L with the aid of a multi-point welding machine. For the sake of simplicity, all that is schematically shown of this multi-point welding machine in FIG. 1 is a lower welding beam 1 and an electrode bank 2, disposed on the welding beam 1, with a number of lower electrodes 3.

One rotating and clamping device on the left and one rotating and clamping device on the right, 4 and 5, respectively, are disposed on the lower welding beam 1 of the multi-point welding machine, on both sides of the advancement path of the longitudinal wires L. Each rotating and clamping device 4, 5 has a bearing body 6, which is secured to a vertical receiving bracket 7 firmly connected to the lower welding beam 1; the bearing body 6 is guided along a vertical guide groove 8 of the receiving bracket 7 and is adjustable in height via elongated adjusting slits 9 corresponding to the diameters of the longitudinal wires and transverse wires to be welded together.

Each rotating and clamping device 4, 5 has a rotation plate 10 and 10', respectively, which is rotatably supported in the bearing body 6 via a laterally cantilevered by 11 and bearings 12. The rotation plates 10, 10' each have a pivot pin 13 extending parallel to the bearing trunnion 11. Two opposed work cylinders 15, 15' are secured to the bearing body 6, each via a respective securing plate 14, and act with their respective piston rods 16 on opposed sides of the pivot pin 13. One guide body 17 each is secured to the side remote from the bearing trunnion 11 of the respective rotation plates 10, 10' and has a vertically extending guide groove 18. An upper clamping body 19 is disposed vertically displaceably on the guide body 17 along the guide groove 18, while a lower clamping body 20 is connected firmly to the guide body 17. A clamping cylinder 21 secured to the guide body 17 acts with its piston rod 22 upon the upper clamping body 19.

In the upper clamping body 19, an upper clamping slide 23 is supported on bearing rollers 24 so as to be displaceable at an angle of 15° to the horizontal plane and can be moved back into its outset position with the aid of a restoring spring 25. The upper clamping slide has a clamping jaw 26 with an inserted clamping piece 27 that has a roughened surface, being provided with knurling or toothing, for instance, so that it can grasp the transverse wire without slippage and firmly clamp it.

The lower clamping body 20 has a lower clamping slide 28, analogous in structure to the upper clamping slide 23, which is supported in the lower clamping body 20 so as to be displaceable at a negative angle of 15° to the horizontal plane and has clamping jaws 26 and clamping pieces 27 identical to those of the upper clamping slide 23.

The clamping jaws 26 of the upper and lower clamping slides 23 and 28, respectively, are electrically insulated from the respective upper and lower clamping slide 23 and 28 by one insulation piece 29 each.

For adjusting to different widths of the wire grid mats to be produced, the rotating and clamping devices 4, 5 are displaceable counter to one another in the horizontal direction.

Each rotating and clamping device 4, 5 is provided with a separately triggerable control device, not shown.

The apparatus according to the invention functions as follows: By a feeder device, not shown, of the multi-point welding machine, the transverse wire Q is placed in its intended welding position on the longitudinal wires L. Next, the clamping cylinders 21 of the rotating and clamping devices 4, 5 on the right and left are activated simultaneously, so that their piston rods 22 move downward and thereby displace the upper clamping bodies 19, downward, in the downward-pointing direction of the double-headed arrow P1, along the guide groove 18 of the guide body 17. As soon as the clamping jaws 26 have grasped the transverse wire Q by its two ends, the two clamping slides 23, 28 of each rotating and clamping device 4, 5 move outward, along their guide paths inclined from the horizontal plane, within the corresponding clamping bodies 19, 20; the motions of the upper clamping slides 23 have an outward-oriented horizontal component P2, and the motions of the lower clamping slides 28 have a contrary but likewise outward-oriented horizontal component P3. In accordance with these horizontal components P2, P3, the ends of the transverse wire are moved outward, and the transverse wire is thus clamped. The clamping force acting upon the transverse wire depends upon the mechanical properties of the transverse wire and is adjusted by way of the working pressure in the clamping cylinders 21, which can be selected to be only great enough that the transverse wire is clamped sufficiently tautly without plastic deformation.

Next, the work cylinder 15 of the rotating and clamping device 4 on the left and the work cylinder 15' of the rotating and clamping device 5 on the right are activated accordingly, so that the rotation plate 10 of the rotating and clamping device 4 on the left and the rotation plate 10' of the rotating and clamping device on the right execute converse rotary motions, and as a result the left end of the transverse wire is rotated about its longitudinal axis in one direction of the double-headed arrow P5, while the opposed right end of the transverse wire is rotated in a rotary motion opposite the direction of rotation P5, that is, in the direction of the double-headed arrow P6. The angle of rotation is adjustable and by way of example is in the range from 0 to 15°.

After the ends of the transverse wire have been rotated, the upper electrodes, not shown, of the welding machines are then lowered into their welding position, and acted upon by welding pressure and welding current, and the longitudinal wires and transverse wires are welded together at their crossing points. Once the welding process has ended, the upper electrodes move back to their outset position. The clamping cylinders 21 are then triggered in such a way that their piston rods 22 return to their outset position, and as a result the upper clamping bodies 19 likewise move upward, and the lower clamping bodies 20 are relieved. By means of the restoring springs 25, the upper and lower clamping slides 23, 28 are forced back into their outset positions, so that the clamping jaws 26 open and the ends of the transverse wire are released. The work cylinders 15, 15' are then triggered in such a way that their piston rods 16 rotate the pivot pins 13 back into their outset position. The wire grid mat is then advanced accordingly, so that in the ensuing work increment of the welding machine a new transverse wire can be delivered, clamped, rotated, and welded to the longitudinal wires.

Within the scope of the invention, the rotary motions may also be effected in the other directions of rotation indicated by the double-headed arrows P5 and P6, by corresponding activation of the other work cylinders 15' or 15. It is also possible within the scope of the invention to select the magnitude of the rotary motions P5, P6 on the two ends of the transverse wire as being either the same or different. The possibility also exists within the scope of the invention of rotating only one end of the transverse wire while the other end is not rotated.

With the scope of the invention it is moreover possible, during the production of the wire grid mats, for the ends of successive transverse wires to be rotated with either equal-sized or different-sized angles of rotation. The rotational directions of successive transverse wire ends may be either the same or opposite. It is also possible within the scope of the invention, during the production of a wire grid mat, for transverse wires with rotated and nonrotated ends to be made to succeed one another in a freely selectable number and order; the order of the amounts of the rotational angles can be selected arbitrarily.

It is understood that the exemplary embodiment described can be modified in various ways within the scope of the general concept of the invention, in particular with regard to the design of the drive elements for attaining the clamping and rotary motions. The clamping and/or rotary motions may be effected by hydraulic or electric-motor drive means, or via adjusting spindles.

We claim:

1. A method for producing wire grid mats from longitudinal wires and transverse wires crossing one another at right angles and welded at the crossing points, in which the longitudinal wires are advanced incrementally and the transverse wires are moved transversely to the motion of the longitudinal wires into a welding line and are welded to the longitudinal wires, wherein at least one of the transverse wires (Q), after being delivered to the welding line, is clamped with a predetermined adjustable magnitude, and before being welded to the longitudinal wires (L) at least one end of this transverse wire (Q) is rotated about its longitudinal axis by a predetermined adjustable angle, whereupon the transverse wire is welded to the longitudinal wires.

2. The method of claim 1, wherein the two ends of at least one transverse wire (Q) are rotated by equal-sized, oppositely oriented angles.

3. The method of claim 1, wherein the two ends of at least one transverse wire (Q) are rotated by different-sized, oppositely oriented angles.

4. The method of claim 1, wherein within one wire grid mat, the ends of all the successive transverse wires (Q) are rotated by equal-sized angles, preferably in the same direction.

5. The method of claim 1, wherein one wire grid mat, the ends of all the successive transverse wires (Q) are rotated by different-sized angles, preferably in the same direction, the order of the amounts of the rotary angles being selectable, and at least one transverse wire remains unrotated.

6. An apparatus for performing the method of one of claims 1–5, having clamping jaws for grasping the ends of the transverse wires and having clamping devices for clamping the transverse wire in the electrode-equipped welding line of a grid welding machine, wherein on both sides of the longitudinal wire advancement path of the grid welding machine, one rotating and clamping device (4 and 5, respectively) each is disposed; in each rotating and clamping device (4 and 5, respectively), for clamping one transverse wire end, one upper clamping body (19) each and one lower clamping body (20) each are disposed, vertically displaceably and drivably, in a guide body (17), and each clamping body (19 and 20, respectively) has a substantially horizontally displaceable clamping slide (23 and 28, respectively); for rotating one transverse wire end about its longitudinal axis, the guide body (17) is supported with a bearing trunnion (11) rotatably in a stationary bearing body (6); and each rotating and clamping device (4 and 5, respectively) is triggerable separately.

7. The apparatus of claim 6, wherein for clamping a transverse wire end, a work cylinder (21) acting with its piston rod (22) on the upper clamping body (19) and secured to the guide body (17) is provided.

8. The apparatus of claim 6, wherein the guide body (18) has a laterally cantilevered pivot pin (13) extending parallel to the bearing trunnion (11), and the piston rod (16) of one work cylinder (15, 15') each engages opposite sides of the pivot pin (13).

9. The apparatus of claim 6, wherein each upper and lower clamping slide (23 and 28, respectively) has a clamping jaw (26), and each clamping jaw (26), for slip-free firm holding of the transverse wire ends, is provided with a clamping piece (27) with a roughened surface.

10. The apparatus of claim 6, wherein at least one rotating and clamping device (4 and 5, respectively) is displaceable relative to the other for the sake of adapting to different widths of wire grid mats.

11. The apparatus of claim 6, wherein the bearing body (6) of each rotating and clamping device (4 and 5, respectively) is secured so as to be adjustable in height on the welding machine, for the sake of adapting to different diameters of the longitudinal wires and transverse wires.

* * * * *